United States Patent [19]

Grobman

[11] 3,974,768

[45] Aug. 17, 1976

[54] DUAL INK CIRCULATION AND WASH-UP SYSTEM FOR A PRESS

[75] Inventor: William Grobman, Philadelphia, Pa.

[73] Assignee: Molins Machine Company, Inc., Camden, N.J.

[22] Filed: Mar. 31, 1975

[21] Appl. No.: 563,752

[52] U.S. Cl. ..... 101/425; 101/350; 101/366; 141/248

[51] Int. Cl.[2] ..... B41F 35/04; B41L 41/04

[58] Field of Search ..... 101/364, 367, 425, 366, 101/363, 360, 350; 15/256.6, 256.51, 256.52; 134/96; 222/108, 181, 185, 278, 288, 279; 141/89, 104, 248

[56] References Cited

UNITED STATES PATENTS

| | | | |
|---|---|---|---|
| 2,145,630 | 1/1939 | Pilling | 15/256.52 |
| 2,193,051 | 3/1940 | Wood | 134/96 |
| 2,279,691 | 4/1942 | Long et al. | 134/96 X |
| 2,282,770 | 5/1942 | Sarver | 15/256.52 X |
| 2,363,817 | 11/1944 | Taylor | 101/425 X |
| 2,713,866 | 7/1955 | Kaye | 134/96 X |
| 3,060,852 | 10/1962 | Hoelzer et al. | 101/364 |
| 3,097,968 | 7/1963 | Schaffer | 101/364 X |
| 3,309,993 | 3/1967 | Grembecki | 101/425 |
| 3,411,444 | 11/1968 | Boneschi | 15/256.51 X |
| 3,486,448 | 12/1969 | Anderson et al. | 101/425 |
| 3,587,597 | 6/1971 | Courtney | 134/96 X |
| 3,620,232 | 11/1971 | D'Angelo | 134/96 X |
| 3,800,702 | 4/1974 | Roberts | 101/425 |
| 3,896,730 | 7/1975 | Garrett et al. | 101/425 |

*Primary Examiner*—Edgar S. Burr
*Assistant Examiner*—Paul J. Hirsch
*Attorney, Agent, or Firm*—Seidel, Gonda & Goldhammer

[57] ABSTRACT

A printing press is provided with a dual ink circulation and wash-up system to reduce the wash-up time between color changes. The press includes a fountain and at least one receptacle associated therewith and having at least two compartments. Means are provided to selectively divert liquid from the fountain into one of the compartments while the other compartment is being washed. A plurality of ink supply means are provided for sequentially supplying ink to the fountain.

13 Claims, 5 Drawing Figures

DUAL INK CIRCULATION AND WASH-UP SYSTEM FOR A PRESS

BACKGROUND OF THE INVENTION

In the manufacture of corrugated paperboard containers, sheets of paperboard are conveyed through a press such as a printer slotter wherein one surface of the sheets is printed. Also, the sheets are creased and slotted to thereby produce a printed box blank.

In a conventional printer slotter, there is an ink fountain. The fountain is generally defined by two cooperating fountain rollers and a printing plate roller. In some printer slotters, the fountain is defined by only one fountain roller with a cooperating doctor blade. Sheets of paperboard fed into the printer slotter are contacted by the printing plate roller. Printing ink is delivered from a supply source to the trough formed by the juxtaposed fountain rollers. One fountain roller is usually provided with a resilient covering which bears against the ectched or engraved surface of the other fountain roller. A small amount of ink is retained by said surface and then applied to the printing plate roller.

When it is desired to change from one color ink to another, the fountain rollers and the ink circulation system must be completely clean. The cleaning procedure takes substantial time. After the ink present in the trough has been allowed to drain back to the supply container, a wash liquid such as water is circulated through the system until the water runs clear. The time spent in cleaning the system is nonproductive time and therefore there has been a long-felt need for a system to reduce the wash-up time between color changes. The present invention materially reduces the wash-up time.

This invention relates to a dual ink circulation and wash-up system for a press such as a flexographic press for printing sheets of corrugated paperboard. The press supports a printing medium application means. A plurality of printing medium supply means are provided for sequentially supplying the printing medium to said application means.

The system of the present invention includes at least one receptacle positioned adjacent said application means to receive any excess printing medium therefrom. The receptacle has at least two compartments, with each compartment having a drain conduit. Conduit means are provided for connecting each compartment with a wash liquid supply means for selectively introducing a wash liquid thereinto. A means is provided to selectively divert liquid from the application means into one of said compartments.

It is an object of this invention to provide apparatus and/or method to reduce the time required to clean a printing press between color changes.

It is another object of the present invention to provide a novel system which simultaneously facilitates washing part of the system while printing sheets with another part of the system.

It is another object of the present invention to provide a press such as a printer slotter having two ink distribution systems connected to a single ink fountain.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
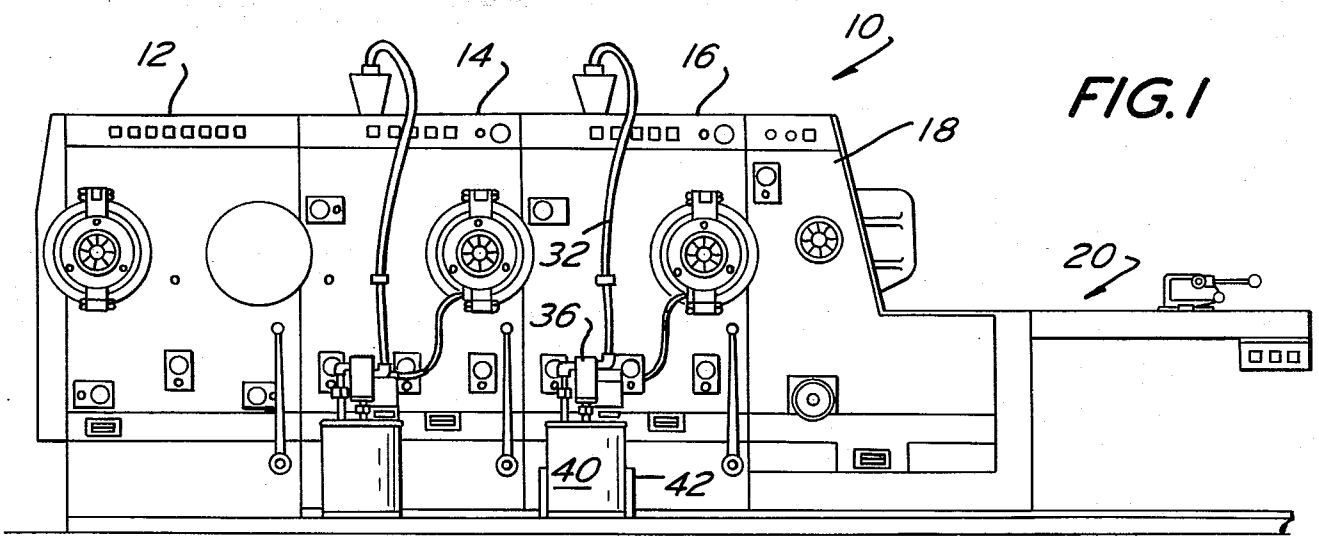
FIG. 1 is a side elevation view of a printing press such as a printer slotter.

Referring to the drawing in detail, wherein like numerals indicate like elements, there is shown in FIG. 1 a printing press 10 in the form of a printer slotter. The press 10 includes a plurality of sections 12, 14, 16 and 18 each of which are adapted to be moved or separated from one another to facilitate access by an operator in a conventional manner. Paperboard sheets are sequentially fed to the sections of the printer slotter by means of a feed table 20.

Figure 2:
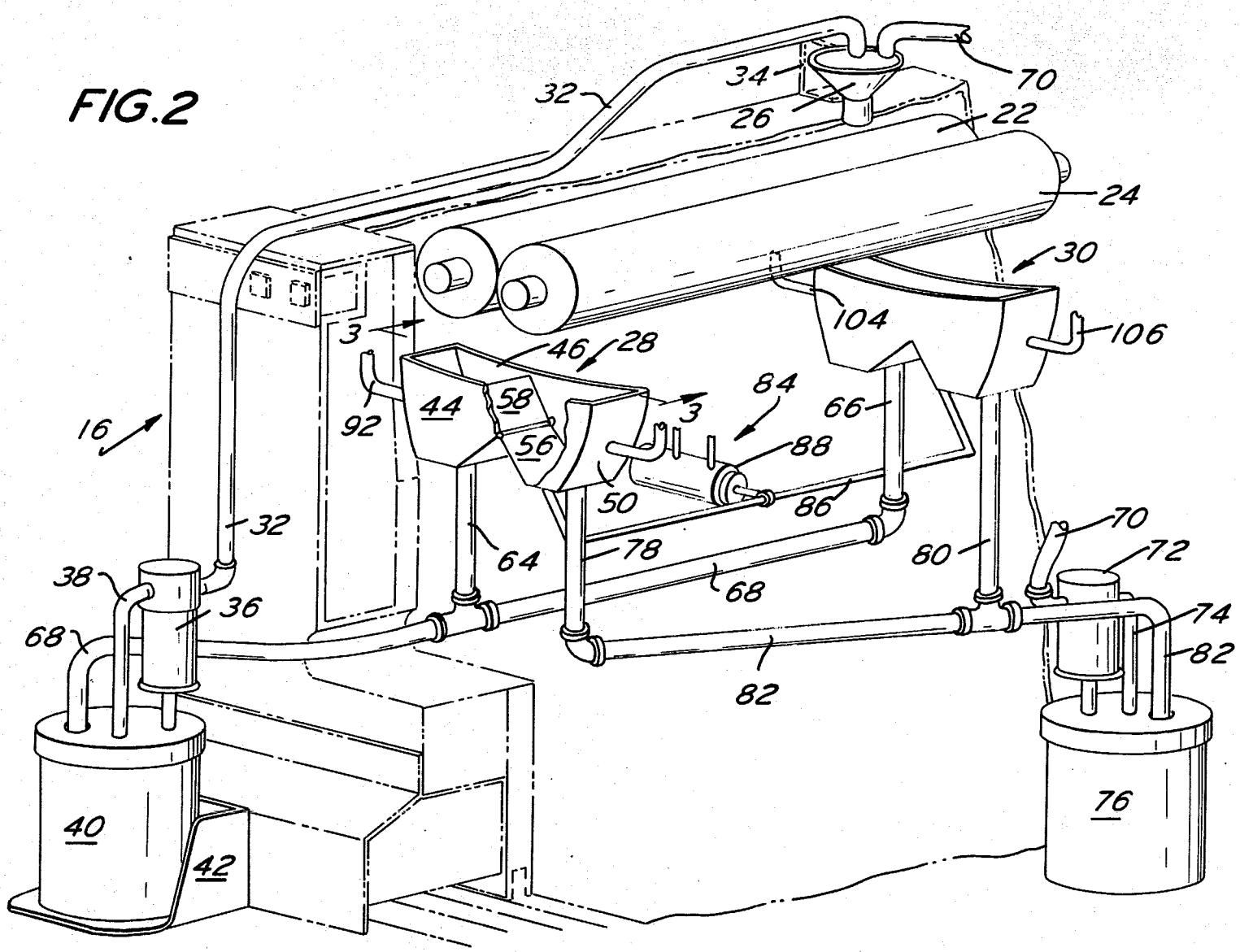
FIG. 2 is a perspective view of a section of a printer slotter which is partly diagrammatic and which illustrates the circulation system.

The press 10 includes a fountain comprised of fountain rollers 22 and 24 rotatably supported by a suitable portion of the frame of section 16. See FIG. 2. A printing medium such as a water soluble ink is introduced into the trough 27 between the rollers 22 and 24 by way of the spout 26. Any excess ink in the fountain is permitted to discharge by gravity into one or more receptacles. As shown in FIG. 2, receptacles 28 and 30 are provided. Each receptacle is adjacent one end of the fountain.

The fountain roller 24 transfers the printing medium from trough 27 to the printing roller 25 disposed between said receptacles 28, 30. Roller 22 performs a metering function and hence could be a stationary doctor blade extending upwardly and to the left in FIG. 3 from roller 24.

A printing medium such as water soluble ink is directed to the spout 26 by way of conduit 32. The end of conduit 32 remote from spout 26 is connected to the output side of a pump 36 having a suitable filter. The input side of pump 36 is connected to a container 40 by way of conduit 38. Container 40 contains a supply of a printing medium such as a water soluble ink. A suitable bracket 42 is provided on the frame of section 16 to support the container 40 in a removable manner. The structure discussed above in connection with press 10 and section 16 is conventional.

The receptacles 28 and 30 are identical except as will be made clear hereinafter. Accordingly, only receptacle 28 will be described in detail. The receptacle 28 includes side walls 44 and 46 connected to end walls 48 and 50.

Figure 3:
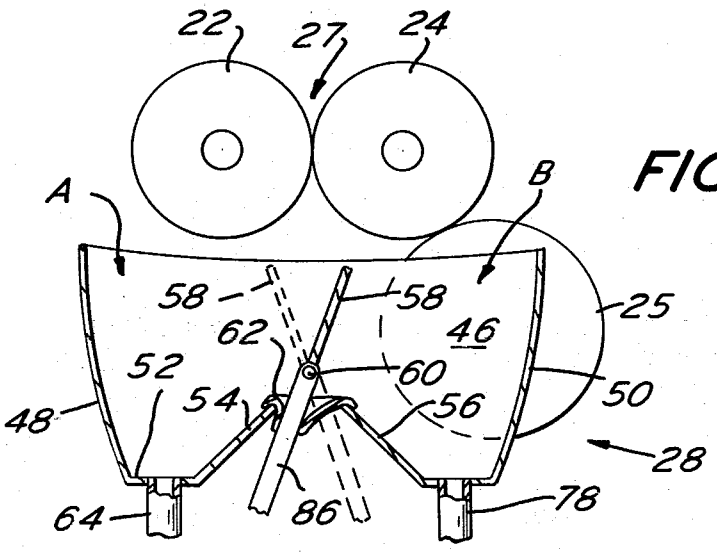
FIG. 3 is a sectional view taken along the line 3-3 in FIG. 2.

In a conventional receptacle, there is only one compartment. In the receptacle 28 of this invention, a bottom wall 52 is provided with wall portions 54 and 56 which are angled upwardly to define a partition which movably supports a diverter 58. Thus, as shown in FIG. 3, the bottom wall portions 54, 56 and the diverter 58 divide the receptacle 28 into compartments designated A and B. Diverter 58 is preferably mounted for pivotable movement between the solid line position and the phantom position about the axis of pin 60. A suitable seal 62 of resilient material is provided between the diverter 58 and the wall portions 54, 56.

Compartment A in receptacle 28 is provided with a drain conduit 64. Compartment A in receptacle 30 is provided with a drain conduit 66. The conduits 64 and 66 are connected to a return conduit 68. Conduit 68 is connected to the container 40. Conduit 68 is inclined toward said container 40 to facilitate gravity flow.

A conduit 70 has one end adjacent the spout 26. The other end of conduit 70 is connected to the output side of pump 72. The input side of pump 72 is connected to a second container 76 by way of conduit 74. Container 76 is adapted to contain a printing medium such as ink but of a different color from that in container 40.

Compartment B of receptacle 28 is provided with a drain conduit 78. Compartment B of receptacle 30 is provided with a drain conduit 80. The conduits 78 and 80 communicate with a return conduit 82. Conduit 82 is angled so as to permit the return of liquid by way of gravity flow to the container 76.

The diverter 58 and the corresponding diverter in receptacle 30 are provided with a common actuator 84 for simultaneous movement. The actuator 84 includes a rod 86 having bent ends connected to the diverters. An intermediate portion of the rod 86 is connected to a piston rod extending from a cylinder 88. Cylinder 88 may be operated by means of a hydraulic liquid or may be a pneumatic cylinder. Alternatively, the actuator 84 may utilize any other equivalent device in place of the cylinder 88, such as a solenoid or a servo mechanism.

A wash liquid main supply conduit for a wash liquid such as water is provided. See FIG. 4. Conduits 92, 94 and 96 each are selectively connected to conduit 90 by way of the valves 98, 100, and 102 respectively. The valves 98-102 are preferably solenoid operated and connected to actuator buttons on a control panel not shown. Likewise, the pumps 36, 72 and the actuator 84 are selectively operable by means of buttons or other means at said control panel.

Conduit 92 is connected to compartment A of receptacle 28. Conduit 94 is connected to compartment B of receptacle 28. Conduit 92 is provided with a branch conduit 104 connected to compartment A of receptacle 30. Conduit 94 is provided with a branch conduit 106 which communicates with compartment B of receptacle 30. Conduit 96 is adapted to discharge into the spout 26.

The system of the present invention permits the press such as the printer slotter 10 to be run in a conventional manner with ink being supplied to the fountain rolls 22, 24 from container 40. When it is desired to cease using the ink from container 40, such as when a production run is complete, the press may be converted to a new production run using ink of a different color from container 76 as follows.

The pump 36 is rendered inoperative. Any ink in conduit 32 drains back again into the container 40. Any ink in compartment A of the receptacles 28 and 30 drains into the container 40 by way of conduits 64, 66 and 68.

Then, conduit 68 is disconnected from container 40 and connected to a drain pipe or some other container not shown. Valve 102 is actuated. A wash liquid such as water is directed by way of conduit 96 and spout 26 to the trough 27. The fountain rollers 22, 24 are thereby cleaned. Excess water from the fountain rollers 22, 24 as well as ink washed off the rollers is received in compartments A and discharges into the drain by way of conduit 68. As soon as the rollers 22 and 24 are clean valve 102 is closed. Roller 25 is generally not washed since it supports the printing die. Conventionally, a change of ink color is associated with a change in printing dies and the dies are cleaned after removal from the press.

Figure 4:
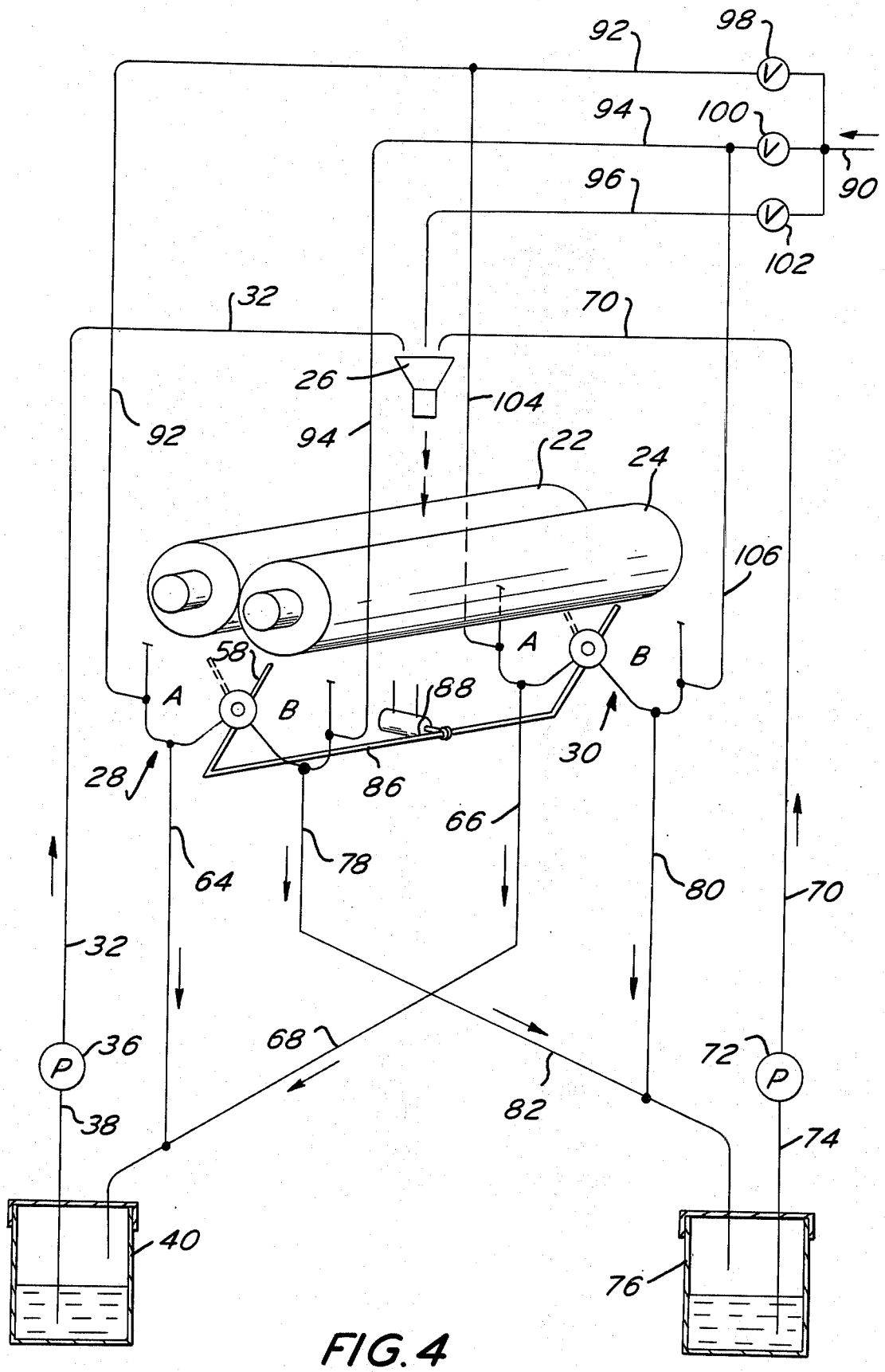
FIG. 4 is a diagrammatic illustration of the liquid circulation system.

Then actuator 84 is operated to move the diverter 58 to the phantom position shown in FIGS. 3 and 4. Pump 72 is operated and ink of a different color is pumped by way of conduit 70 to the spout 26 and then to the trough 27. Printing of sheets is resumed. Valve 98 is actuated and wash water is intoduced by way of conduits 92 and 104 to the compartments A of the receptacles 28 and 30. The wash liquid washes the compartments A and associated conduits 64, 66 and 68 while printing resumes with excess ink being received from the fountain rollers in the compartments B. Hence, the down time is limited only to a short period of time necessary to clean the fountain rollers 22 and 24. Complete wash-up of compartments A is attained during printing of the next production run using ink from container 76 and with the trough 27 communicating with compartments B.

Where the printing medium is a water soluble ink, the wash liquid is preferably water. The nature of the wash liquid is dictated by the nature of the printing medium which need not be water soluble.

Figure 5:
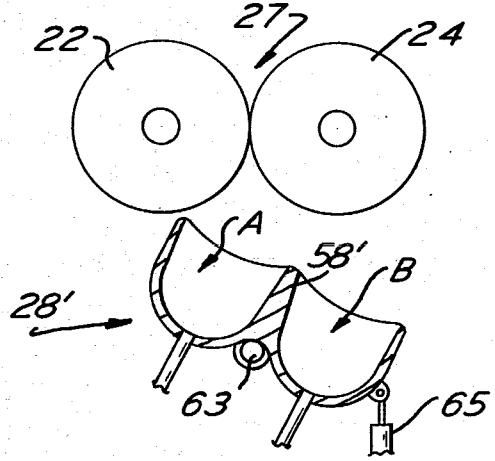
FIG. 5 is a sectional view similar to FIG. 3 but showing another embodiment of the present invention.

While the form of receptacle described above constitutes a preferred embodiment of the invention, it is to be understood that other embodiments may be utilized. One such embodiment is shown in FIG. 5. In this embodiment, a receptacle 28' is provided in which the two compartments A and B are separated by a fixed diverter or partition 58'. The receptacle 28' is employed in a tilted position so that liquid from the trough 27 will flow directly into compartment A. When it is desired to change ink colors after the fountain rollers 22, 24 have been washed, the receptacle 28' is tilted about shaft 63 to the opposite direction so that liquid may flow from the trough 27 into the previously unused compartment B. The receptacle 28' may be tilted by a hydraulic actuator 65 similar to that previously described or by hand.

The present invention may be embodied in other specific forms without departing from the spirit or essential attributes thereof and, accordingly, reference should be made to the appended claims, rather than to the foregoing specification as indicating the scope of the invention.

I claim:

1. A system for distributing a printing medium and a wash liquid comprising a printing press, an elongated printing medium application means supported by the press, a plurality of discrete supply means for sequentially supplying a printing medium to said application means, at least one receptacle positioned adjacent said application means to receive any excess printing medium therefrom, said receptacle having at least two compartments, each compartment having a drain conduit, conduit means connecting each compartment with a wash liquid supply means for selective introduction of a wash liquid into said compartments and means to selectively divert liquid from said application means into only one of said receptacle compartments at any given time so that printing may be accomplished while the other compartment is being cleaned by a wash liquid from said wash liquid supply means.

2. A system in accordance with claim 1 wherein said means to selectively divert liquid includes a diverter supported by said receptacle and an actuator connected to said diverter, said receptacle being below the elevation of said application means.

3. A system in accordance with claim 2 wherein said receptacle includes a centrally disposed partition, said diverter being a portion of said partition.

4. A system in accordance with claim 1 including a spout above said application means, each printing medium supply means including a conduit extending to said spout, said conduit means for connecting each compartment with a wash liquid supply means including a conduit extending to said spout.

5. A system in accordance with claim 1 including two such receptacles, each receptacle being adjacent to and extending beyond a different end of said application means, and an actuator for simultaneously moving the diverter means associated with each receptacle.

6. Apparatus comprising a printing press, an ink fountain having a printing roller and a fountain roller supported by the press, a plurality of discrete ink supply means for sequentially supplying a water soluble printing ink to said fountain roller, at least one receptacle positioned adjacent said fountain roller to receive excess printing ink therefrom, said receptacle having at least two compartments, each compartment having a drain conduit, conduit means connecting each compartment with a wash water supply means for selective introduction of water into said compartments, and means to selectively divert excess ink from said fountain roller into only one of said receptacle compartments at any given time so that printing may be accomplished while the other compartment is being cleaned by water from said wash water supply means.

7. Apparatus in accordance with claim 6 wherein said means to selectively divert ink includes a diverter supported by said receptacle and an actuator connected to said diverter, a metering means cooperating with said fountain roller to define a trough, said receptacle and diverter being below the elevation of said trough.

8. Apparatus in accordance with claim 7 wherein a pair of said receptacles is provided with each receptacle being adjacent a different end of the trough.

9. Apparatus in accordance with claim 7 including a spout above said trough, each printing ink supply means including a conduit extending to said spout, said conduit means for connecting each compartment with a wash water supply means including a conduit extending to said spout.

10. A system for selectively distributing a printing medium and a wash liquid in a printing press comprising a printing medium application means supported by the press, a plurality of discrete supply means for sequentially supplying a printing medium to said application means, at least one receptacle positioned adjacent said application means to receive printing medium or wash liquid therefrom, a diverter fixedly disposed in said receptacle defining two discrete compartments, each compartment having a drain conduit, conduit means connecting each compartment with a wash liquid supply means for selective introduction of a wash liquid into said compartments, and means for moving said receptacle to selectively divert liquid from said application means into only one of said compartments so that printing medium from one of said supply means may be supplied to said application means and received in one of said compartments while the other of said compartments is being cleaned by a wash liquid from said wash liquid supply means.

11. A method for selectively distributing printing inks of different colors and a wash liquid in a printing press comprising the steps of providing a printing press having a fountain with an excess ink receptacle means having first and second discrete compartments for sequentially receiving excess ink from said fountain, printing with ink of a first color and diverting any excess ink into said first compartment, then washing said first compartment with a wash liquid to remove ink of a first color therefrom, feeding ink of a second color to said fountain while diverting excess ink of said second color from said fountain to said second compartment, and printing a substrate with ink of said second color while simultaneously performing said washing step thereby avoiding the necessity of completing the washing step of the first compartment before commencing with said steps of feeding and printing with ink of said second color.

12. A method in accordance with claim 11 including moving a partition disposed in said receptacle and which separates said compartments before said feeding step.

13. A method in accordance with claim 11 including moving said receptacle before said feeding step to thereby position said second compartment in an ink receiving location.

* * * * *